United States Patent [19]

Kuhns

[11] Patent Number: 4,557,504

[45] Date of Patent: Dec. 10, 1985

[54] METHOD FOR THWARTING FORGERY OF FINGERPRINT-BEARING IDENTIFICATION MEDIA

[76] Inventor: Roger J. Kuhns, Tower Rd., Lincoln, Mass.

[21] Appl. No.: 458,528

[22] Filed: Jan. 17, 1983

[51] Int. Cl.[4] ..... B42D 15/00

[52] U.S. Cl. ..... 283/68; 283/69; 283/78

[58] Field of Search ..... 283/68, 69, 78, 67–70, 283/904; 33/1 BB, 1 M, 1 PT, 1 C, 430

[56] References Cited

U.S. PATENT DOCUMENTS

| | | | |
|---|---|---|---|
| 752,617 | 2/1904 | DePue | 283/1 A |
| 1,380,506 | 6/1921 | Voght . | |
| 2,007,589 | 7/1935 | Williams . | |
| 2,048,879 | 7/1936 | Moran . | |
| 2,712,514 | 7/1955 | English | 283/78 X |
| 3,186,091 | 6/1965 | Pawlowski | 33/1 BB |
| 3,336,671 | 8/1967 | Puckett . | |
| 3,419,287 | 12/1968 | Rudie . | |
| 3,564,266 | 2/1971 | Klotz | 283/69 X |
| 3,769,709 | 11/1973 | Clarke et al. . | |
| 4,260,646 | 4/1981 | Farrell et al. | 283/70 X |
| 4,305,667 | 12/1981 | Nachtrieb | 283/70 X |
| 4,325,570 | 4/1982 | Estrada . | |

*Primary Examiner*—Paul A. Bell
*Assistant Examiner*—Taylor J. Ross
*Attorney, Agent, or Firm*—Robert L. Nathans

[57] ABSTRACT

A reliable, precise, inexpensive, portable digitizer is provided for receiving an identification medium having a fingerprint thereon, including at least one fingerprint discontinuity associated therewith. The exact position of the discontinuity with respect to the edges of the medium is then encoded by the digitizer by rotating an elongated scale coupled to the base of the digitizer until the fiducial line on the scale is coincident with the discontinuity. A reading is thereafter recorded proportional to the position of the discontinuity along the elongated scale and a reading is also recorded indicative of the angle of the elongated scale, with respect to the base member. These readings are recorded upon the medium, and since the medium has an exact position with respect to the base member, the recorded data is proportional to the position of the discontinuity relative to the dimensions of the card. The above procedure is repeated during verification of the authenticity of the medium, and if the readings match, the medium is deemed authentic.

13 Claims, 2 Drawing Figures

METHOD FOR THWARTING FORGERY OF FINGERPRINT-BEARING IDENTIFICATION MEDIA

BACKGROUND OF THE INVENTION

This invention relates to the field of security and more specifically the prevention of the forgery of an identification card or the like.

Photo identification cards have been provided by many years to enable identification of the bearer of the card. One well-known example is a driver's license bearing the photo of the bearer. In many countries of the world, citizenship I.D. cards are issued to each citizen for positive identification purposes. Security is enhanced by employing a fingerprint in conjunction with a photo. In one form of I.D. card, a photograph of the bearer is taken and a thumb print of the bearer is recorded upon the back of the photograph, which is thereafter fitted into an aperture formed within an inner card portion, which also bears other information, such as the name of the bearer, etc. The inner card portion is thereafter laminated between two sheets of transparent plastic by heat and pressure. While it is difficult to de-laminate the card to substitute a forged inner card, such de-lamination can be carried out. One approach of forging an I.D. card is to de-laminate the outer plastic sheets and substitute another photograph of the person desiring to own such a forged card, in place of the photograph of the legitimate bearer, previously positioned within the originally-issued card. It is possible to perform this step by having the original fingerprint of the original card holder or the fingerprint of another, placed upon the back of the newly substituted photograph. This procedure represents a potential breach of security. Accordingly, a rapid, efficient and inexpensive method of thwarting this procedure is desirable. Such method is also applicable to cards bearing a fingerprint, but not employing a photo.

SUMMARY OF THE PRESENT INVENTION

In accordance with a method of the present invention, a special digitizer is provided, which records the exact position of a fingerprint discontinuity or discontinuities, with respect to the edges of an identification medium such as, for example, a laminated plastic I.D. card. The digitizer is relatively inexpensive, portable, and reliable in operation. A preferred embodiment employs a pivotable elongated scale which bears a fiducial line, rotated by the operator until the line is coincident with the fingerprint discontinuity, after the identification medium is fitted into a positioning well of the digitizer. Data proportional to the distance from the discontinuity to the pivot point of the elongated scale and the angular position of the scale, is thereafter recorded upon the medium with visible or invisible ink or the like, for example, within a data processor. The identification medium is thereafter issued to the bearer. Verification of the issued medium is carried out at a later time by an operator who repeats the above-mentioned procedure after the medium is repositioned upon the digitizer. Since it is extremely unlikely that the fingerprint discontinuity or discontinuities of a forged identification medium will have the exact same position with respect to the geometry of the medium, even if the fingerpring is the same as the original bearer of the card, such as forged medium may readily be detected, since the data measured during verification will not match the data recorded upon issuance. This method also produces a greater degree of security than the use of passwords, assigned to the original bearer since passwords are, in contrast, readily transferrable from the original bearer to another.

Other objects, features, and advantages of the present invention will become apparent upon study of the following detailed description taken in conjunction with:

FIG. 1 which illustrates a plan view of the digitizer; and

FIG. 2 which is a partial sectional view of the digitizer.

DETAILED DESCRIPTION

Figure 1:
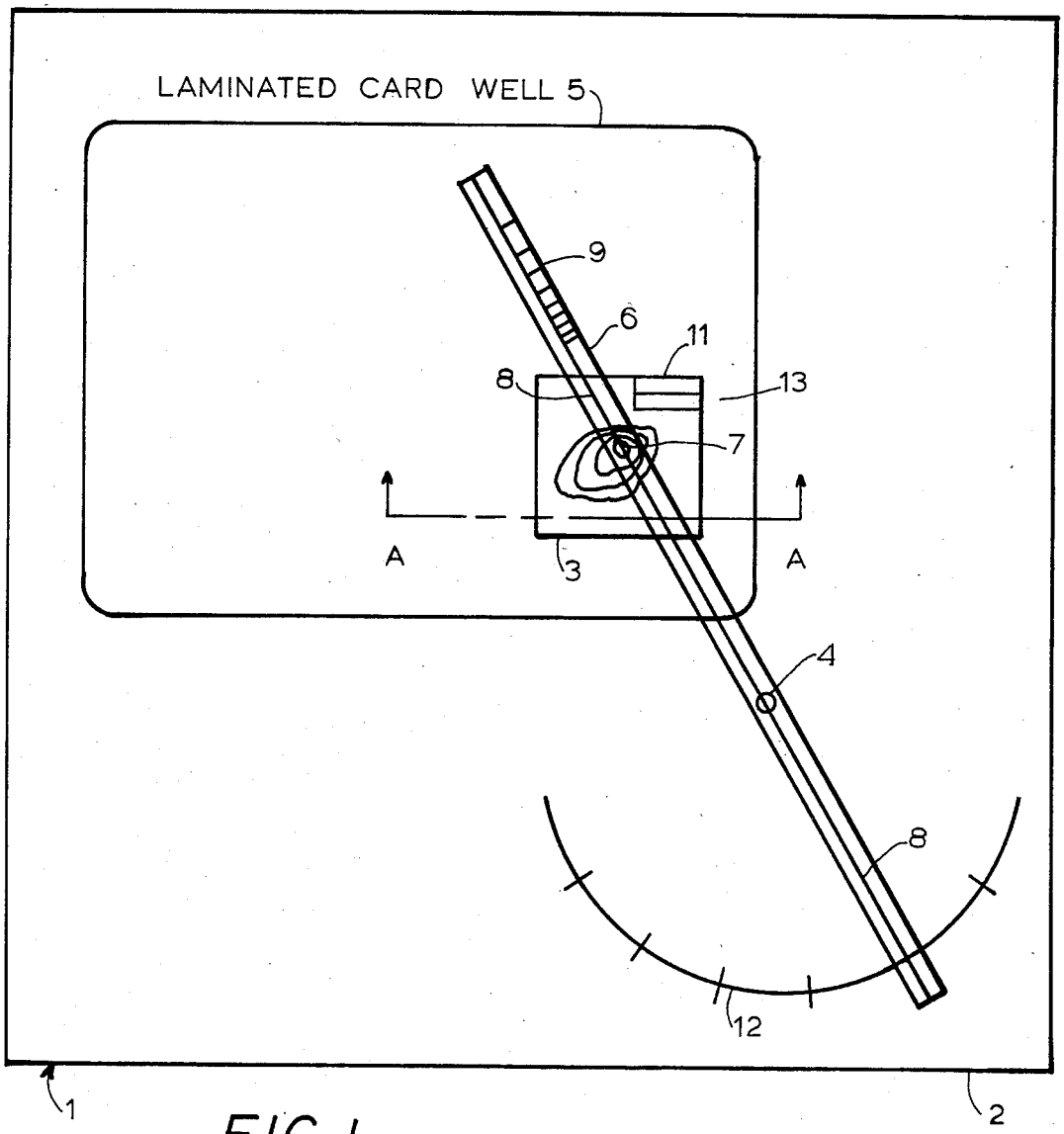
Figure 2:
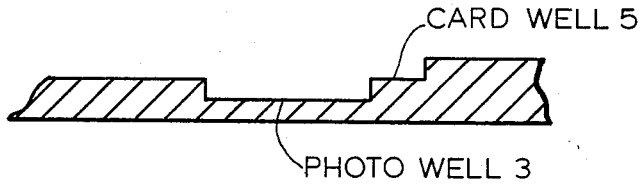

In accordance with a preferred method of the present invention, a photograph of the bearer is taken and a right thumb print of the bearer is formed upon the back of the photograph. A unique digitizer 1 is provided, illustrated in FIG. 1, having a base member 2 which could be a flat, plastic sheet having a rectangular photo positioning well 3 formed therein. The photo with the fingerprint side up is snuggly fitted within well 3 so that its exact position is predetermined with respect to pivot member 4, which rotatably couples the elongated measuring cable 6 to base member 2. In other words, well 3 functions as a precise photo identification medium position referencing means. Although several fingerprint discontinuities are generally present, often the most prominent one is the center of the closed loop or "vortex" of the fingerprint pattern, illustrated at point 7. Others which could be employed are ends of lines (ridges) or line intersections, e.g., "Y".

The above-mentioned encoding or recording of the exact position of vortex 7 is carried out by having the operator rotate elongated scale 6 until fiducial line 8 formed upon the transparent scale 6 is coincident with vortex 7, as illustrated in the figure. Fiducial scale markings 9 are formed along the length of the scale so that the operator is able to read off a distance measurement proportional to the distance between vortex 7 and pivot member 5. This distance measurement may be recorded directly upon the photo in distance code portion 11 and/or could be otherwise recorded in, for example, an electronic data processor. It is preferred that the spacings between the scale markings be variable in accordance with a non-linear scale such as a log or other esoteric scale, so as to further confuse the forgerer in his attempt to ascertain the nature of the encoding procedure. The angular reading of the position of fidicual line 8 is read off of the angular scale 12 and may be recorded within angle code portion 13 of the photo and/or recorded within a data processor. The photo could itself be employed as the issued identification medium if typed material is added, or could be incorporated within a three-part laminated data card. In the latter case, the photo is thereafter fitted into a rectangular cutout formed within an information-bearing inner sheet having the name of the bearer, etc., typed thereon. The inner sheet is thereafter laminated to a pair of outer sheets, typically by heat and pressure to form a composite I.D. card, (see U.S. Pat. No. 3,679,512 issued to Roger Kuhns).

Let it be assumed at a later time an operator desires to verify the authenticity of the identification medium. In the case of a non-laminated card where the photo alone bearing the fingerprint is the issued identification medium, the photo is inserted into photo well 3 of the same type of second digitizer having the exact same size and shape as the first digitizer 1 which was employed previously upon issuance of the card. The above-mentioned steps of rotating the elongated scale until fiducial line 8 coincides with discontinuity vortex 7, is carried out and distance and angle codes are noted by the operator. This data is now compared with the angle and distance codes previously recorded upon the photo card and/or inserted into a data processor before issuance, and if there is a match, the photo card will be considered authentic. However, if the photo card identification medium is a forgery, it is extremely unlikely that the angle and distance codes read off by the operator upon verification, will match the original codes impressed upon the card during issuance. The inventor has determined through experimentation that it is extremely difficult to record the fingerprint vortex at the exact same position with respect to the edges of the photograph and thus, the fruits of this experimentation represents an important aspect of the present invention. This is so, even if the fingerprint used in the counterfeiting operation is from the same person as the print originally recorded. Of course if the person is different, the counterfeiting process is even more difficult, due to the different pattern and positions of the various discontinuities. Greater security is obtainable by optionally measuring, recording and later matching two or more fingerprint discontinuities.

In the case where the encoded photograph is laminated within outer plastic sheets to produce a plastic I.D. card upon issuance, verification is performed by inserting the plastic I.D. card into card well 5 (shown in the figures) and verification is carried out as before. The rectangular cutout within the inner paper core sheet laminated between the outer plastic sheets is precisely positioned with respect to the edges of the laminated card, so that the vortex 7 will be in the exact same position with respect to the pivot point 4 as the vortex would be if the photo is unlaminated. Alternatively, the fingerprint-bearing photo could be laminated before the vortex position is encoded, but this approach is less preferred. Thus, the term "identification medium" could include the laminated 3-part plastic I.D. card, in addition to the fingerprint-bearing photo, per se. Also, data indicative of the relative position of the fiducial, with respect to the base member, is intended to include data which partially describes the absolute position of the discontinuity, e.g., only angle data read off of scale 12.

While a rotatable pointer is greatly preferred, it is within the scope of the invention to employ other discontinuity position encoders and readers such as a pointer or other fiducial means coupled to, for example, a rectangular X, Y encoder-reader. Such devices are well known in the art. A cylindrical lens bearing the fiducial line may be used to advantage as a pointer scale. It is within the scope of the invention to move the base and maintain the fiducial stationary, to produce relative motion between these two members. The method of the invention may be practised with a single digitizer or many, employed at various places, and may be practised without employing a photo at all.

The scope of the present invention is to be limited only by the scope of the following claims and equivalents thereof.

What is claimed is:

1. A method of verifying the authenticity of an identification card having a fingerprint, including at least one fingerprint discontinuity, recorded thereon comprising the steps of:

a. providing at least one digitizer having a base member, fiducial means movable with respect to said base member, said referencing means for positioning said identification card at a precise predetermined position upon said base member;

b. positioning said identification card at said referencing means;

c. producing relative motion between said fiducial means and said base member until said fiducial means coincides with said fingerprint discontinuity;

d. recording data from said fiducial means indicative of the exact position of said discontinuity with respect to said base member;

e. positioning said identification card at the referencing means of a digitizer substantially identical to said at least one digitizer at a later time;

f. repeating step c; and g. comparing the data resulting from carrying out steps e and f with data previously recorded in accordance with steps b, c and d.

2. A method of verifying the authenticity of an identification card having a fingerprint, including at least one fingerprint discontinuity, recorded thereon comprising the steps of:

a. providing at least one digitizer having a base member, fiducial means having at least one scale associated therewith, movable with respect to said base member, and referencing means for positioning said identification card at a precise predetermined position upon said base member;

b. positioning and identification card at said referencing means;

c. producing relative motion between said fiducial means and said base member until said fudicial means coincides with said fingerprint discontinuity;

d. recording data from the scale of said fudicial means indicative of the exact position of said discontinuity with respect to said base member;

e. repositioning said identification card at the referencing means of a digitizer substantially identical to said at least one digitizer at a later time;

f. repeating step c; and g. comparing the data resulting from carrying out steps e and f with data previously recorded in accordance with steps b, c and d.

3. The method as set forth in claim 2 wherein the data resulting from carrying out step d is recorded upon said identification card.

4. The method as set forth in claim 2 wherein the data obtained by carrying out step d is inserted into a data processor.

5. The method of claim 2 wherein said scale includes non-linearly spaced measuring markings.

6. A method of verifying the authenticity of an identification card having a fingerprint, including at least one fingerprint discontinuity, recorded thereon comprising the steps of:

a. providing at least one digitizer having a base member, elongated fiducial means having an elongated scale associated therewith and pivotably mounted to said base, an angular scale positioned upon said base adjacent said elongated fiducial means and position referencing means for positioning said identification card at a precise predetermined position upon said base;

b. positioning said identification card at said referencing means;

c. rotating said elongated fiducial means until said fiducial means coincides with said fingerprint discontinuity;

d. recording the reading from said elongated scale aligned with said discontinuity;

e. recording the angle from said angular scale indicative of the angular position of said fiducial means when said fiducial means is coincident with said discontinuity;

f. repositioning said identification card at said referencing means of a digitizer substantially identical to said at least ond digitizer at a later time;

g. repeating step c; and h. comparing the data resulting from carrying out step g with previously recorded data recorded in accordance with steps b, c, d, and e.

7. The method as set forth in claim 6 wherein the data resulting from carrying out steps d and e is recorded upon said card.

8. The method of claim 6 wherein at least one of said scales includes non-linearly spaced measuring markings.

9. The method as set forth in claim 8 wherein the data resulting from carrying out steps d and e is recorded upon said card.

10. A method of verifying the authenticity of an identification card having a fingerprint, including at least one fingerprint discontinuity, recorded thereon comprising the steps of:

a. providing at least one digitizer having a base, fiducial means pivotably mounted to said base at a predetermined pivot point, an angular scale positioned upon said base adjacent said fiducial means and position referencing means for positioning said identification card at a precise predetermined position upon said base;

b. positioning said identification card at said referencing means;

c. rotating said fiducial means until said fiducial means coincides with said fingerprint discontinuity;

d. recording the angle from said angular scale indicative of the angular position of said fiducial means rotated in accordance with step c;

e. repositioning said identification card at said referencing means of a digitizer substantially identical to said at least one digitizer at a later time;

f. repeating step c;

g. comparing the data resulting from carrying out step f with previously recorded data recorded in accordance with steps b, c, and d.

11. The method as set forth in claim 10 wherein the data resulting from carrying out steps b, c and d is recorded upon said card.

12. The method as set forth in claim 10 wherein the data resulting from carrying out steps b, c and d is inserted into a data processor.

13. The method of claim 10 wherein said angular scale includes non-linearly spaced measuring markings.

* * * * *